United States Patent [19]

Johanson et al.

[11] Patent Number: 4,510,037

[45] Date of Patent: Apr. 9, 1985

[54] HYDROGENATION PROCESS FOR SOLID CARBONACEOUS FEED MATERIALS USING THERMAL COUNTERCURRENT FLOW REACTION ZONE

[75] Inventors: Edwin S. Johanson, Princeton; Paul D. Schuler, Hamilton Square, both of N.J.

[73] Assignee: HRI, Inc., Gibbsboro, N.J.

[21] Appl. No.: 565,248

[22] Filed: Dec. 23, 1983

[51] Int. Cl.[3] ..... C10G 1/08

[52] U.S. Cl. ..... 208/8 LE; 208/11 LE; 208/10

[58] Field of Search ..... 208/8 LE, 11 LE, 107, 208/10

[56] References Cited

U.S. PATENT DOCUMENTS

| | | | |
|---|---|---|---|
| 3,488,278 | 1/1970 | Nelson | 208/10 |
| 3,503,864 | 3/1970 | Nelson | 208/10 |
| 3,852,182 | 12/1974 | Sze et al. | 208/10 |
| 3,852,183 | 12/1974 | Snell | 208/10 |
| 3,856,658 | 12/1974 | Wolk et al. | 208/8 LE |
| 3,932,266 | 1/1976 | Sze et al. | 208/10 |
| 4,090,957 | 5/1978 | Leonard | 208/8 LE |
| 4,094,766 | 6/1978 | Gorin | 208/8 LE |
| 4,111,788 | 9/1978 | Chervenak et al. | 208/10 |
| 4,121,995 | 10/1978 | Hsu | 208/10 |
| 4,217,112 | 8/1980 | Johanson | 208/8 LE |
| 4,221,653 | 9/1980 | Chervenak et al. | 208/8 LE |
| 4,224,136 | 9/1980 | zu Köcker et al. | 208/8 LE |
| 4,272,501 | 6/1981 | Greskovich et al. | 208/8 LE |
| 4,298,451 | 11/1981 | Neuworth | 208/8 LE |
| 4,401,551 | 8/1983 | Mitchell | 208/11 LE |

*Primary Examiner*—Delbert E. Gantz
*Assistant Examiner*—Lance Johnson
*Attorney, Agent, or Firm*—Fred A. Wilson; H. Montgomery Hougen

[57] ABSTRACT

Thermal hydrogenation of solids-containing carbonaceous feed materials to produce hydrocarbon gaseous and liquid products is performed in a thermal reaction zone, in which the feed material flows generally downwardly countercurrent to upflowing hydrogen and recycled hydrocarbon liquid. The recycled hydrocarbon liquid is at a rate sufficient to control the settling of solids-containing feed through the reactor, and is obtained from the reaction zone upper end by phase separation from gaseous effluent at reaction conditions. The gaseous effluent material is removed from the thermal reaction zone upper end, and heavy liquid material containing less than about 40 W % solids is withdrawn from the reaction zone bottom end, with both streams being passed to further phase separation and distillation steps for recovery of the hydrocarbon gas and liquid products. The process is useful for hydroconversion of solids-containing tar sand bitumen, shale oil and particularly for coal, with the coal being fed into the thermal reaction zone as a coal-oil slurry. If desired, the heavy liquid bottoms stream withdrawn from the lower end of the thermal reaction zone containing unconverted coal and ash solids can be advantageously passed to a second reaction zone containing an ebullated catalyst bed for further hydrogenation reaction to increase the conversion and yield of low-boiling hydrocarbon liquid products.

12 Claims, 2 Drawing Figures

HYDROGENATION PROCESS FOR SOLID CARBONACEOUS FEED MATERIALS USING THERMAL COUNTERCURRENT FLOW REACTION ZONE

BACKGROUND OF INVENTION

This invention pertains to a thermal hydrogenation and conversion process for solids-containing carbonaceous feed materials utilizing countercurrent flow of the feed and hydrogen to produce hydrocarbon gas and liquid products. It pertains particularly to such process wherein a thermal countercurrent flow hydrogenation reaction zone is used upstream of a catalytic hydrogenation reaction zone.

In thermal hydrogenation conversion operations on solids-containing carbonaceous feed material such as coal to produce lower boiling product liquids and gases, the feed material and hydrogen have generally both been introduced into the bottom of the reactor and both passed upwardly therethrough. However, reactor plugging difficulties sometimes occur due to heavy particulate mineral matter that forms in the reactor, settles and accumulates as solids agglomerates in the bottom of the reactor. Such accumulated solids in the reactor interfere with sustained process operations and are thus quite undesirable.

Accumulation of solids in the lower end of a hydrogenation reactor can usually be avoided by a periodic or continuous withdrawal of such solids. For example, U.S. Pat. No. 1,838,549 to Haslam and U.S. Pat. No. 1,876,006 to Krauch disclose processes for coal hydrogenation using stirred catalyst reactors to produce low boiling oil products, in which a liquid stream containing solids is withdrawn from the lower end of the reactors. Also, U.S. Pat. No. 3,488,278 to Nelson discloses a catalytic process for liquefying coal using continuous countercurrent extraction, in which ash and residue including solid catalyst particles are withdrawn from the reactor lower end along with minimal hydrocarbon liquid. U.S. Pat. No. 3,660,267 to Rieve et al discloses a non-catalytic coal hydrogenation process using an upflow reactor with contact solids being purged intermittently from the bottom end as needed. These alternative arrangements have deficiencies in practical large scale operations, involving high expense for stirring mechanisms, high expense in providing adequate liquid flow to assure sufficient time for solids to be dissolved in a liquefying solvent, difficulties in withdrawing high solids content material from the liquefying reactor, and operational upsets associated with the intermittent withdrawal of agglomerated accumulations from the liquefying reactor. U.S. Pat. No. 4,111,788 to Chervenak et al discloses a two-stage coal hydrogenation process using a thermal first stage reactor and catalytic second stage reactor, however, a counterflow arrangement for the coal feed and hydrogen in either reactor is not used.

Thus, a definite need exists for an improved thermal hydrogenation and liquefaction process for solids-containing carbonaceous materials such as coal and utilizing countercurrent flow of the feed and hydrogen so as to avoid the above difficulties associated with an undesirable accumulations of solids in the reaction zone lower end.

SUMMARY OF INVENTION

The present invention discloses a process for thermal hydrogenation and conversion of a solids-containing carbonaceous feed material to produce hydrocarbon gaseous and liquid products, and utilizes a thermal reaction zone which provides a counter-current flow arrangement for the downflowing feed material of solids slurried in solvent and upflowing hydrogen and a recycled hydrocarbon liquid conveniently and economically derived from the process. A principally gaseous effluent material is removed from the reaction zone upper end and is phase separated at near reaction conditions to provide the recycled hydrocarbon liquid at a rate sufficient to control settling of the solids-containing feed material through the reactor. A heavy liquid product containing less than about 40 W % total solids is withdrawn from the reaction zone lower end, with the streams from both upper and lower ends of the reaction zone being passed to further phase separation and distillation steps for recovery of hydrocarbon gas and liquid products.

More specifically, the invention provides a continuous process for thermal hydrogenation and conversion of solids-containing carbonaceous feed materials to produce hydrocarbon gaseous and liquid products, which comprises introducing a solids-containing carbonaceous feed material into the upper portion of a thermal reaction zone, and introducing hydrogen and a recycled hydrocarbon liquid into the bottom portion of said reaction zone for upward flow therethrough countercurrent with the carbonaceous feed material to provide hindered settling of solids therein; hydrogenating the carbonaceous feed material in said reaction zone at conditions within ranges of 750°–900° F. temperature and 1000–5000 psi hydrogen partial pressure to form a hydrocarbon gaseous and liquid effluent mixture; withdrawing the hydrocarbon effluent mixture from the top of the reaction zone, and phase separating the mixture at near reaction conditions to recover separate gas and liquid fractions, and recycling the hydrocarbon liquid fraction to the lower portion of said reaction zone to provide the hindered settling of solids therein, and withdrawing a hydrocarbon liquid material from the bottom of the reaction zone along with solids and agglomerates formed therein, and passing said liquid, agglomerates and solids material to further processing steps to recover hydrocarbon liquid products, whereby accumulation of agglomerates and solids in the reaction zone lower end is prevented.

The present process is useful for hydrogenation of any solids-containing carbonaceous feed material including but not limited to coal, such as bituminous, sub-bituminous, and lignite, bitumen derived from tar sands, raw shale oil and heavy petroleum residua containing metals compounds and mineral matter. The process is preferably useful for the hydrogenation and liquefaction of coal containing about 5–20 W % mineral matter or ash.

It is an advantage of the present invention that long reaction times for liquefaction of solids-containing carbonaceous materials are achieved in the thermal reactor such as when withdrawing a substantial portion of the effluent solids material from the reactor upper end, but persistent plugging problems caused by accumulation of high concentrations of solids in the reactor lower end are avoided. The invention is particularly useful for hydrogenating and liquefying coal containing high concentrations of material matter or ash, such as 10–20 W % ash in the coal.

DESCRIPTION OF INVENTION

Figure 1:
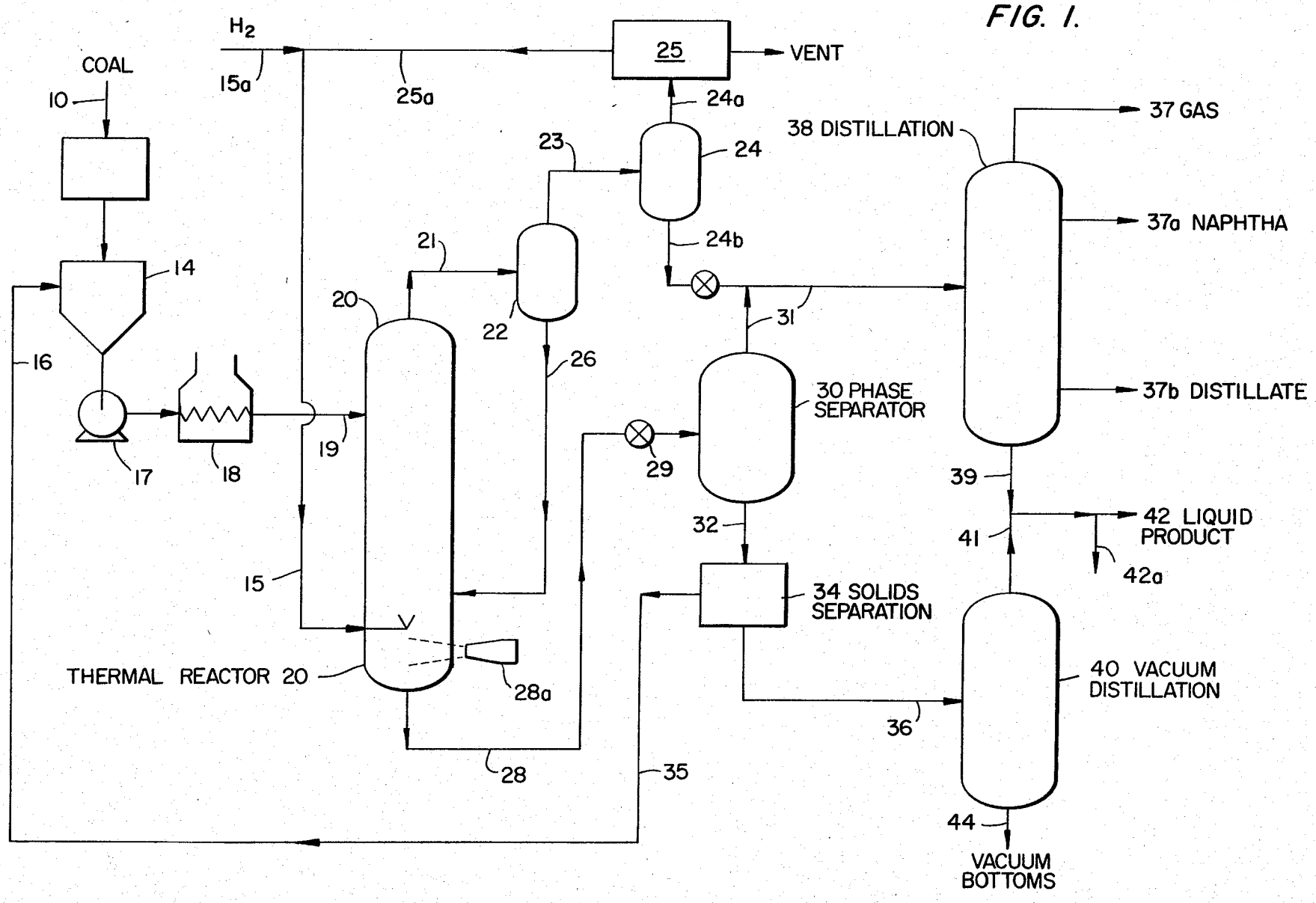
FIG. 1 is a schematic drawing showing a coal hydrogenation process utilizing a thermal reaction zone arranged for downward flow of a coal slurry feed countercurrent to upflowing hydrogen and a hydrocarbon liquid to produce hydrocarbon gas and liquid products.

In the present invention for thermal hydrogenation of coal, the coal feed is introduced as a coal-oil slurry into the upper portion of the thermal reaction zone, and hydrogen and a recycled hydrocarbon liquid are introduced into the bottom portion and flow upwardly through the coal slurry in the reaction zone to provide hindered settling of the coal solids. The downward flow of the coal-particles and upward flow of hydrogen and recycled liquid provides sufficient residence time for the hydrogenation and conversion reactions of the coal to produce significant yields of hydrocarbon gases and liquids, and the flow arrangement precludes undesirable accumulation of agglomerated solids in the reaction zone lower end.

The coal particle residence time in the thermal reaction zone is increased and controlled by providing the recycle of a light liquid effluent from the reactor upper end back to the lower portion of the reactor. Such liquid recycle provides an upflowing liquid velocity which retards the settling rate of the unconverted coal solids in the reaction zone and thereby increases their residence and reaction times therein. Also, the upflow of hydrogen gas provides some agitation and desirably strips hydroconverted light ends fractions from the reactor liquid.

Reaction conditions useful in the thermal reaction zone are within the range of 750°-900° F. temperature and 1000-5000 psi hydrogen partial pressure. A small temperature gradient usually exists within the reaction zone. The downflow of liquid below the hindered settling recycle injection point serves to carry the ash particulates out of the reaction zone before they increase in size or accumulate therein in an excessive concentration or quantity. The total solids concentration in the liquid slurry in the reaction zone lower end should usually not exceed about 40 W %, and is preferably maintained at about 20-35 W % of the slurry therein. The solids concentration in the reactor lower end is monitored by a suitable nuclear device. When the coal feed is slurried with a recycled slurrying oil, the solids in the reaction zone lower end will contain about an equal percentage of unconverted coal and mineral matter. A light hydrocarbon effluent stream is withdrawn from the upper end of the reaction zone, and is phase separated at near reaction conditions to provide the recycled hydrocarbon liquid at a rate sufficient to control the settling of the coal solids through the reactor. A heavy hydrocarbon liquid material containing solids and agglomerates is withdrawn from the lower end of the reaction zone and net streams from both the upper end and lower end of the reactor are passed to phase separation and distillation steps for recovery of the hydrocarbon gas and liquid products.

Alternatively, the heavy liquid material containing solids withdrawn from the bottom portion of the countercurrent flow thermal reaction zone of this invention can be advantageously passed directly on to an ebullated bed catalytic reaction zone, in which such material is further hydrogenated and converted to produce increased yields of lower-boiling hydrocarbon liquids and gas products.

As shown in FIG. 1, coal such as bituminous, subbituminous or lignite at 10 is introduced into a preparation unit 12, wherein the coal is ground to a desired particle size and dried to remove substantially all surface moisture. For this process, the coal feed should have a particle size of 20-350 mesh (U.S. Sieve Series). The coal particles are passed to slurry mix tank 14 where the coal is blended with sufficient slurrying oil at 16 to provide a pumpable mixture. This slurrying oil is produced in the process as described below, and the weight ratio of oil to coal should be at least about 1.1 but need not exceed about 6.

The coal-oil slurry is pressurized by pump 17 and passed through slurry heater 18, in which the slurry is heated to a temperature at least about 700° F. so that the desired reaction zone temperature will be attained by the heat of reaction. The heated slurry at 19 is then introduced into the upper portion of thermal reactor 20. Heated hydrogen at 15 is introduced into the bottom portion of the reactor 20, and passes upwardly in countercurrent flow relation with the coal feed. The coal and hydrogen flow in countercurrent relation to provide a controlled residence time for the coal, with the hydrogenation reactions being achieved therein without use of an added catalyst.

Reaction conditions in the thermal reactor 20 are maintained within the broad range of 750°-900° F. temperature and 1000-5000 psi hydrogen partial pressure, and preferably at 800°-880° F. temperature and 1500-4500 psi hydrogen partial pressure. Feed rate for the coal can be within the range of 15-50 pounds coal/hr/ft$^3$ reactor volume, and preferably is 20-40 pounds/hr/ft$^3$.

An effluent stream of gas and light liquid, is withdrawn at 21 from the reactor upper end and is passed to phase separator 22 maintained at near reaction conditions. From separator 22, the resulting vapor portion 23 is usually cooled and passed to further phase separation at 24 and then to hydrogen purification step 25. Recovered hydrogen stream at **25*a* is reheated and recycled at 15 to the reactor 20, with make-up hydrogen being provided at 15*a* as needed. From separator 24, the liquid portion 24*b* is passed to an atmospheric distillation step 38. Alternatively, the separation function of separator 22 can be accomplished within the upper end of reactor 20**.

From hot separator 22, liquid fraction 26 is recycled to the bottom of reactor 20 at a level above the inlet for hydrogen stream 15 for providing an upward liquid flow velocity therein to hinder the downward flow and settling of coal solids and heavy liquids to provide for controlled increased residence time for the unconverted coal particles and for achieving desired thermal hydrogenation reactions in the reactor. The recycle weight ratio of recycle stream 26 to coal in feed stream 19 should usually be within the range of from about 5-50. The solids concentration in the lower end of reactor 20 should not exceed about 40 W % solids in the slurry, and will preferably be maintained at 20-35 W % by controlling the slurry withdrawal rate through conduit 28 in combination with the recycle oil stream 16. The solids concentration in the reactor lower end can be monitored by a suitable nuclear device 28*a*.

From reactor 20, a bottom stream 28, mostly all boiling above about 500° F. and containing residual non-distillable oil, unconverted coal and mineral matter solids, is withdrawn from the lower end of thermal reactor 20, and is pressure-reduced at 29 and passed to phase separator 30. From separator 30, the vapor portion 31 is passed to atmospheric distillation step 38, from which hydrogen gas and liquid product streams are withdrawn as desired. Usually a hydrocarbon gas is withdrawn at 37, a naphtha fraction at 37*a* and a distillate fraction withdrawn at 37*b*.

The resulting bottoms stream 32 from separator 30 is passed to a liquid-solids separation step 34, from which at least a portion of overflow stream 35 containing reduced solids concentration is used as the slurrying oil 16. The remaining bottoms stream 36 containing increased solids concentration is passed to vacuum distillation step 40, from which overhead stream 41 comprises a portion of the liquid product stream 42. A heavy vacuum bottoms stream 44 containing oil normally boiling above about 975° F. and containing unconverted coal and mineral matter is withdrawn for separation of oils from solids by solvent means, or for gasification or disposal. If needed, a portion 42*a* of product liquid stream 42 can be recycled to supplement slurrying oil 16.

Figure 2:
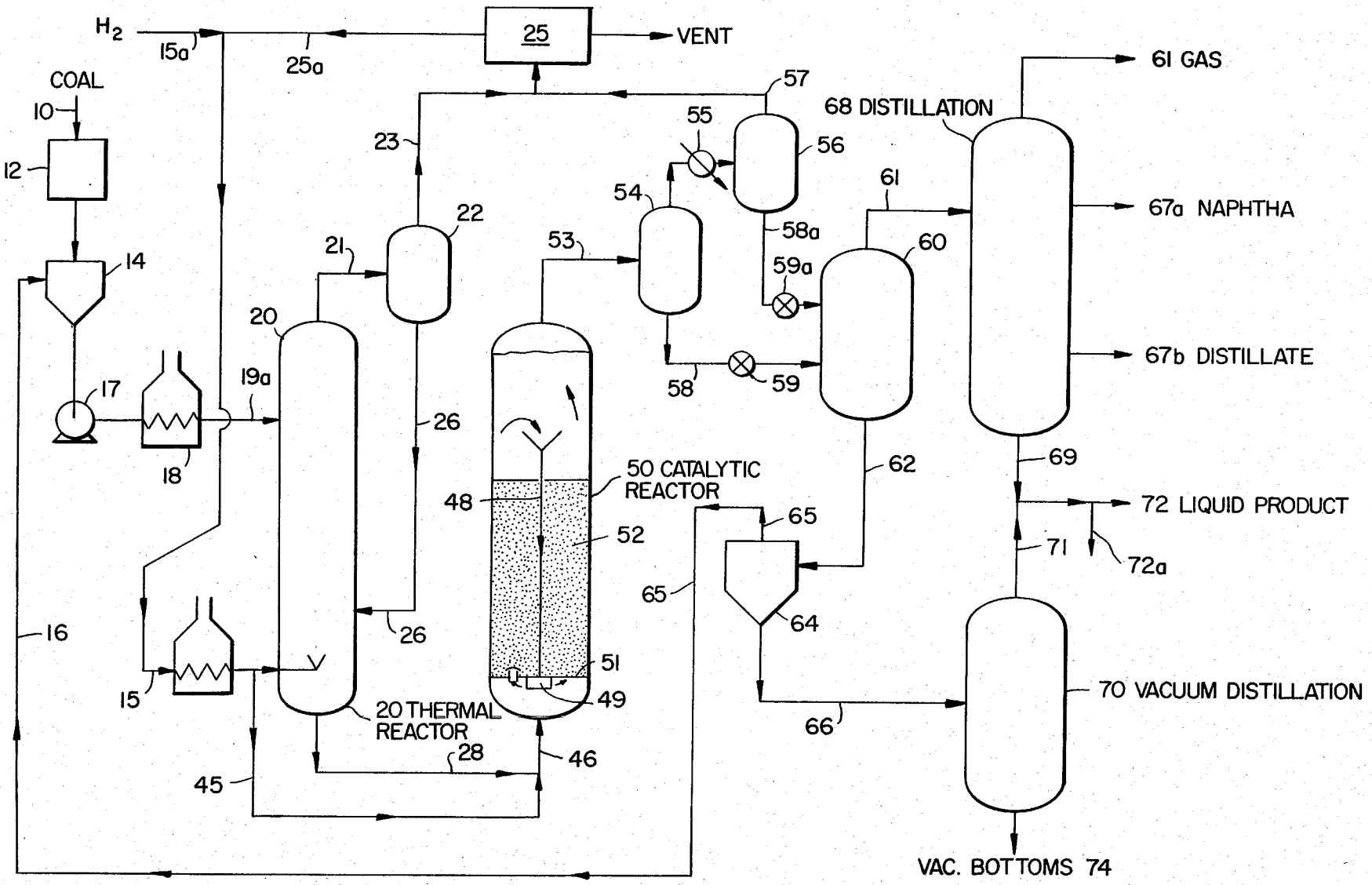
FIG. 2 is a schematic flowsheet showing a thermal countercurrent flow reaction zone used upstream of an ebullated catalyst bed reaction zone to produce increased yields of light hydrocarbon liquid products.

An alternative embodiment of the present invention is shown in FIG. 2, which is similar to the FIG. 1 embodiment except that bottoms liquid stream withdrawn from the countercurrent flow thermal reactor 20 is passed with hydrogen at 45 on to a second reactor 50 containing an ebullated catalyst bed for further catalytic hydrogenation reaction and conversion to produce increased yields of lower-boiling liquid products. As shown in FIG. 2, from reactor 20 light effluent stream 21 is passed to phase separator 22, from which vapor stream 23 is passed to hydrogen purification step 25. From separator 22, liquid stream 26 is recycled to thermal reactor 20, similarly as for the FIG. 1 embodiment. Also, bottom liquid stream 28 withdrawn from the lower end of thermal reactor 20 is passed with hydrogen 45 as stream 46 into the lower end of reactor 50, which contains an ebullated bed of a particulate commercial hydrogenation catalyst 52. Useful catalysts are cobalt-molybdenum or nickel-molybdenum on alumina support in the form of extrudates having diameter of $0.030 \propto 0.065$ inch. In this FIG. 2 embodiment, the bottoms liquid stream 28 is introduced into the catalytic reactor 50 with hydrogen through distributor 51 and passes upwardly through the catalyst bed.

Reaction conditions in catalytic reactor 50 are maintained within the broad range of 750°–875° F. temperature and 1000–4000 psi hydrogen partial pressure, and preferably at 770°–870° F. and 1500–3500 psi hydrogen partial pressure. Space velocity for the coal therein can be within the range of 15–50 pounds coal/hr/$ft_3$ reactor volume, and preferably is 20–40 pounds/hr/$ft^3$. The liquid and gas mixture is passed uniformly upwardly through the catalyst bed 52 at a velocity sufficient to expand the bed by 10–100% over its settled height and to achieve intimate contact of the liquid slurry with the catalyst, using commercially known procedures. The reactor liquid is recycled through downcomer 48 and pump 49 back to flow distributor 51.

An effluent stream of liquid and gas mixture is withdrawn from the reactor upper end at 53 and is passed to hot phase separator 54. The resulting vapor portion is usually cooled at 55 and passed to further phase separation at 56, from which vapor stream 57 is passed to hydrogen purification step 25. Recovered hydrogen stream 25*a* is recycled at 45 to the thermal reactor 20, and at 46 to reactor 50.

From phase separator 54, bottoms liquid stream 58 is pressure-reduced at 59 and passed to phase separator 60, along with liquid stream 58*a* from separator 56. From separator 60, a vapor portion 61 is removed and passed to atmospheric distillation step 68, from which overhead hydrocarbon gas product can be withdrawn at 67, naphtha at 67*a*, distillate liquid at 67*b*, and bottoms liquid withdrawn at 69. Also, from separator 60, the resulting bottoms liquid stream 62 is passed to a liquid-solids separation step 64, which is preferably multiple hydroclone units connected in parallel. An overflow stream 64 containing reduced solids concentration is used as slurrying oil at 16. The remaining bottoms stream 66 containing an increased concentration of unconverted coal and ash solids is passed to vacuum distillation step 70. An overhead stream 71 is usually combined with bottoms stream 69 to provide a liquid product stream 72. A heavy vacuum bottoms stream 74 boiling above about 975° F. and containing some unconverted coal and ash solids is withdrawn for solvent separation, gasification and/or disposal. If needed, a portion 72*a* of product stream 72 can be recycled to supplement slurrying oil stream 16.

The process of the present invention will be further explained by reference to the following example, which should not be construed as limiting the scope of the invention.

EXAMPLE

A bituminous coal such as Illinois No. 6 coal is particulate form is slurried with a coal-derived slurrying oil and fed into the upper portion of a thermal reactor. Hydrogen and recycle hydrocarbon oil are introduced into the reactor lower portion for upward flow therein countercurrent to the downflowing coal particles. The coal particles are dissolved and liquefied in the reactor, from which a vapor fraction containing hydrogen and low boiling hydrocarbon material is removed from the reactor upper end. Heavy liquid containing unreacted coal and ash particles is withdrawn from the reactor lower end and is passed to further processing steps. Operating conditions and results of the thermal hydrogenation reaction step are summarized in Table 1 below.

TABLE 1

| Coal Feed | Illinois No. 6 Coal |
|---|---|
| Slurrying Oil/Coal Ratio | 1.5 |
| Reaction Conditions: | |
| Temperature, °F. | 850 |
| Pressure, psig | 1450 |
| Hydrogen Partial Pressure, psi | 2000 |
| Coal Feed, Lbs/Hr/$Ft^3$ Reactor | 25 |
| Slurrying Oil, Lbs/Lb Coal | 2.0 |
| Reactor Liquid Viscosity, cps | 1.0 |
| Liquid Recycle Ratio (Hindered Settling) | 10 |
| Solids Concentration in Reactor Lower End, W % | 30 |
| Yields, W % Coal Feed | |
| $C_1$–$C_3$ Gases | 5 |
| $C_4$–350° F. Naphtha | 4 |
| 350–650° F. Distillate Oil | 16 |
| 650–975° F. Fuel Oil | 17 |
| 975° F.+ Residuum | 24 |
| Unconverted Coal | 5 |

TABLE 1-continued

| Coal Feed | Illinois No. 6 Coal |
|---|---|
| Ash | 10 |
| Coal Solution, W % of M.A.F. Coal | 94 |

From the above results, it is noted that the coal is thermally hydrogenated to produce gaseous and liquid products. Total solids concentration in the reactor lower end of about 30 W % is maintained by continuous withdrawal of liquid without any problems of plugging in the reactor. Liquid recycle ratios of 10–30 are needed to provide adequate hindered settling of coal particles in the reactor with a liquid viscosity of about 1.0 centipoise. For lower viscosity of reactor liquid an increased recycle rate is required and for higher viscosity reactor liquid a lower recycle ratio is required.

Although this invention has been disclosed in terms of the accompanying drawings and preferred embodiments, it will be appreciated by those skilled in the art that adaptations and modifications of the process may be made within the spirit and scope of the invention, which is defined solely by the following claims.

We claim:

1. A continuous process for thermal hydrogenation and conversion of solid carbonaceous feed materials to produce hydrocarbon gaseous and liquid products, and avoid accumulation of solids and agglomerates in the reaction zone, which process comprises:

(a) introducing a solid carbonaceous feed material into the upper portion of a thermal reaction zone, and introducing hydrogen and a recycled hydrocarbon liquid into the bottom portion of said reaction zone for upward flow therethrough countercurrent with said carbonaceous feed material so as to provide hindered settling of solids therein;

(b) hydrogenating the carbonaceous feed material in said reaction zone at conditions within ranges of 750°–900° F. temperature and 1000–5000 psi hydrogen partial pressure and without an added catalyst material to form a hydrocarbon gaseous and liquid effluent mixture;

(c) withdrawing said hydrocarbon effluent mixture from the top of the reaction zone, phase separating the mixture at near reaction conditions to recover separate gas and liquid fractions, and recycling all of the hydrocarbon liquid fraction to the lower portion of said reaction zone to provide said hindered settling of solids therein; and (d) withdrawing from the bottom of the reaction zone a hydrocarbon liquid slurry material comprising solids and agglomerates not exceeding about 40 weight percent of the liquid slurry, and passing said liquid together with agglomerates and solids material to further processing steps to recover hydrocarbon liquid products, whereby accumulation of agglomerates and solids in the reaction zone lower end is prevented.

2. The thermal hydrogenation process of claim 1, wherein said phase separating step occurs external to the reaction zone.

3. The thermal hydrogenation process of claim 2, wherein the reaction zone conditions are within the range of 800°–880° F. temperature, 1500–4500 psi hydrogen partial pressure, and the coal space velocity is 15–50 pounds coal/hour/ft$^3$ reaction zone volume.

4. The thermal hydrogenation process of claim 1, wherein the carbonaceous feed is particulate coal mixed with a slurrying oil in an oil/coal weight ratio of between about 1.0 and 6.

5. The thermal hydrogenation process of claim 4, wherein the weight ratio of recycled hydrocarbon liquid to coal feed is between about 5 and 50.

6. The thermal hydrogenation process of claim 4, wherein the coal feed contains about 5–20 W % mineral matter.

7. The thermal hydrogenation process of claim 1, wherein said liquid fraction is recycled to the lower portion of said reaction zone at a level above the hydrogen inlet and flows upwardly therein to hinder the downward flow of said hydrocarbon feed material and thereby increase its reaction time therein.

8. The thermal hydrogenation process of claim 1, wherein the heavy hydrocarbon liquid stream withdrawn from the bottom of said thermal reaction zone is phase separated and distillated for further recovery of hydrocarbon liquid products.

9. The thermal hydrogenation process of claim 1, wherein said hydrocarbon liquid material withdrawn from the bottom of said reaction zone has solids concentration maintained at 20–35 W %.

10. The process of claim 1, wherein the liquid material withdrawn from the thermal reaction zone bottom portion is passed with additional hydrogen into an ebullated bed catalytic reaction zone at conditions within ranges of 750°–875° F. temperature, 1000–4000 psi hydrogen partial pressure and 15–40 pounds coal/hr/ft$^3$ space velocity, for further hydroconversion of residuum and unconverted coal to produce increased yield of lower boiling hydrocarbon liquids.

11. A continuous process for thermal hydrogenation and conversion of coal to produce hydrocarbon gaseous and liquid products, and avoid accumulation of solids and agglomerates in the reaction zone, which process comprises:

(a) mixing coal in particulate form with slurrying oil sufficient to form a pumpable mixture;

(b) introducing the coal-oil slurry feed material into the upper portion of a thermal reaction zone, and introducing hydrogen and a recycled hydrocarbon liquid into the bottom portion of said reaction zone for upward flow therein countercurrent with said slurry feed material to provide for hindered settling of the coal particles therein;

(c) hydrogenating the coal-oil slurry in said reaction zone at conditions within the ranges of 800°–880° F. temperature and 1500–4500 psig hydrogen partial pressure and coal space velocity of 15–40 pounds coal/hr/ft$^3$ and without an added catalyst to form a hydrocarbon gaseous and liquid mixture;

(d) withdrawing the hydrocarbon gaseous effluent mixture from the upper portion of the reaction zone, phase separating the mixture to recover separate gas and liquid fractions, and recycling all of said liquid hydrocarbon fraction to the lower portion of said reaction zone for upward flow therein and to provide said hindered settling of solids therein; and (e) withdrawing from the bottom of said reaction zone a hydrocarbon liquid slurry material containing unconverted coal and ash solids not exceeding about 40 weight percent of the liquid slurry and passing said slurry material to further processing steps to recover hydrocarbon liquid products, whereby accumulation of coal agglomerates and solids in the reaction zone lower end is prevented.

12. A continuous process for thermal hydrogenation and conversion of coal to produce hydrocarbon gaseous and liquid products, and avoid accumulation of solids and agglomerates in the reaction zone, which process comprises:

(a) mixing coal in particulate form with a slurrying oil sufficient to form a pumpable mixture;

(b) introducing the coal-oil slurry feed material into the upper portion of a thermal reaction zone, and introducing hydrogen and a recycled hydrocarbon liquid into the bottom portion of said reaction zone for upward flow therein countercurrent with said slurry feed material so as to provide for hindered settling of the coal particles therein;

(c) hydrogenating the coal-oil slurry in said reaction zone at conditions within the ranges of 775°–900° F. temperature and 1500–4500 psig hydrogen partial pressure to form a hydrocarbon gaseous and liquid mixture;

(d) withdrawing the hydrocarbon gaseous effluent mixture from the upper portion of the reaction zone, phase separating the mixture to recover separate gas and liquid fractions, and recycling all of said liquid hydrocarbon fraction to the lower portion of said reaction zone for upward flow therein and to provide said hindered settling of solids therein; and (e) withdrawing from the bottom of said reaction zone a hydrocarbon liquid slurry material containing unconverted coal and ash solids, passing said liquid and solids with additional hydrogen into an ebullated bed catalytic rection zone maintained within ranges of 770°–870° F. temperature, 1500–3500 psi hydrogen partial pressure and 15–50 pounds coal/hr $ft^3$ reaction zone volume for further hydroconversion of residuum and unconverted coal to produce increased yields of lower boiling coal-derived hydrocarbon liquids, and passing the effluent from said ebullated bed reaction zone to further processing steps to recover hydrocarbon liquid products, whereby accumulation of coal agglomerates and solids in the reaction zone lower end is prevented.

* * * * *